US009037324B2

(12) United States Patent
Faller et al.

(10) Patent No.: US 9,037,324 B2
(45) Date of Patent: May 19, 2015

(54) METHOD FOR CONTROLLING A SHIP PROPULSION SYSTEM COMPRISING A SURFACE PROPELLER

(75) Inventors: Christian Faller, Langenargen (DE); Oliver Haller, Friedrichshafen (DE); Adelbert Kern, Kressbronn (DE); Alfred Moehrle, Eriskirch (DE); Markus Mueller, Eriskirch (DE); Michael Welte, Meckenbeuren (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 1283 days.

(21) Appl. No.: 12/443,192

(22) PCT Filed: Sep. 25, 2007

(86) PCT No.: PCT/EP2007/008317

§ 371 (c)(1),
(2), (4) Date: Aug. 5, 2009

(87) PCT Pub. No.: WO2008/037423

PCT Pub. Date: Apr. 3, 2008

(65) Prior Publication Data

US 2010/0030410 A1 Feb. 4, 2010

(30) Foreign Application Priority Data

Sep. 27, 2006 (DE) ..... 10 2006 045 685

(51) Int. Cl.
*B63H 21/21* (2006.01)
*B63H 5/125* (2006.01)

(Continued)

(52) U.S. Cl.
CPC ..... *B63H 5/125* (2013.01); *B63H 21/22* (2013.01); *B63H 2001/185* (2013.01)

(58) Field of Classification Search
CPC .. B63H 5/125; B63H 21/22; B63H 2001/185; B63H 21/21; B63H 21/213; B63H 2021/216; B63H 5/1252
USPC ..... 440/1, 53, 55, 57, 66, 61 R; 701/21
See application file for complete search history.

(56) References Cited

U.S. PATENT DOCUMENTS 4,534,738 A 8/1985 McKnight
4,639,192 A * 1/1987 Harrell ..... 416/27

(Continued)

FOREIGN PATENT DOCUMENTS

DE 195 15 481 10/1996
DE 10048103 C2 9/2002

(Continued)

*Primary Examiner* — Stephen Holwerda
(74) *Attorney, Agent, or Firm* — Lucas & Mercanti, LLP; Klaus P. Stoffel

(57) ABSTRACT

A method for controlling a ship propulsion system including a surface propeller, in which the desired capacity is interpreted as the target rotational value, the rotational speed control deviation is calculated from the desired rotational value and the actual rotational value of the internal combustion engine and an injection quantity for the rotational control of the internal combustion engine is determined using the rotational speed control deviation on a rotational speed controller. The trim position of the surface propeller is controlled by an arrangement controller in accordance with the capacity reserve of the internal combustion engine and the actual trim position and the effective rotational speed, the trim position being determined from the rotational speed control deviation.

11 Claims, 4 Drawing Sheets

(51) Int. Cl.
*B63H 21/22* (2006.01)
*B63H 1/18* (2006.01)

(56) References Cited

U.S. PATENT DOCUMENTS

| | | | | | |
|---|---|---|---|---|---|
| 4,939,660 | A | | 7/1990 | Newman et al. | |
| 5,171,172 | A | * | 12/1992 | Heaton et al. | 440/1 |
| 5,203,727 | A | * | 4/1993 | Fukui | 440/1 |
| 5,326,294 | A | | 7/1994 | Schoell | |
| 5,352,137 | A | * | 10/1994 | Iwai et al. | 440/1 |
| 5,647,780 | A | * | 7/1997 | Hosoi | 440/53 |
| 5,785,562 | A | * | 7/1998 | Nestvall | 440/1 |
| 5,862,794 | A | * | 1/1999 | Yoshioka | 123/486 |
| 6,431,927 | B1 | | 8/2002 | Sage | |
| 6,458,003 | B1 | * | 10/2002 | Krueger | 440/1 |
| 2002/0174818 | A1 | | 11/2002 | Von Wolske et al. | |
| 2003/0077953 | A1 | * | 4/2003 | Kaji | 440/1 |
| 2004/0014376 | A1 | * | 1/2004 | Noyes | 440/66 |
| 2010/0030410 | A1 | | 2/2010 | Faller et al. | |

FOREIGN PATENT DOCUMENTS

| | | | |
|---|---|---|---|
| DE | 102006045685 | B4 | 7/2006 |
| WO | 0230740 | A1 | 4/2002 |
| WO | 2004/020281 | | 3/2004 |
| WO | 2004020281 | A1 | 3/2004 |

* cited by examiner

METHOD FOR CONTROLLING A SHIP PROPULSION SYSTEM COMPRISING A SURFACE PROPELLER

This application is a 371 of PCT/EP2007/008317 filed Sep. 25, 2007, which in turn claims the priority of DE 10 2006 045 685.8 filed Sep. 27, 2006, the priority of both applications is hereby claimed and both applications are incorporated by reference herein.

BACKGROUND OF THE INVENTION

The invention concerns a method for automatically controlling a marine propulsion system with a surface-piercing propeller.

Surface-piercing propellers are often used in fast ships. Surface-piercing propellers can be varied both in their depth of immersion and towards port or starboard to control the ship. Hereinafter, the depth of immersion of the surface-piercing propeller will be referred to as the trim position. In this regard, a trim position of +100% corresponds to a maximum emersion position, and a trim position of −100% corresponds to a maximum immersion depth of the propeller. In practice, a ship's navigator sets the subjectively best trim position by means of a control element. However, this results in an additional burden on the navigator besides his nautical tasks. During dynamic operations, he often lacks the criteria for evaluating the best trim position.

WO 2004/020281 A1 discloses a measure for improving this situation. It proposes a method for automatically adjusting a surface-piercing propeller as a function of the current operating state of the ship. The current operating state in turn is derived from the ship's speed, a steering angle, the position of a throttle control, and parameters of the internal combustion engine. However, this source does not describe a practical embodiment.

DE 195 15 481 A1 discloses a method and a device for the automatic load control of a marine propulsion system with a variable-pitch propeller. This device comprises a closed-loop speed control system for automatically controlling the speed of revolution of the internal combustion engine and a system controller for controlling the variable-pitch propeller. From the power desired by the navigator, i.e., the throttle control setting, a set speed is computed by a first engine map as a reference input for the closed-loop speed control system. A set blade pitch to be used as a setpoint value for the system controller is likewise derived from the power desired by the navigator by means of a second engine map. The set blade pitch is then converted by the system controller to an actuating variable for the variable-pitch propeller. This process also takes into account the power reserve of the internal combustion engine, a speed control deviation, and a speed gradient in accordance with an increase or decrease of the blade pitch.

In this method, a large change in the desired power brings about a change in the set speed and the set blade pitch that is immediate and in the same direction. The closed-loop speed control system has a large system-related step response time. Therefore, a change in the correcting variable, for example, the injection quantity, produces a change in the actual speed and in the quantities derived from it only after a time delay. The set blade pitch, on the other hand, is rapidly converted by the control unit to an actuating variable for the variable-pitch propeller. Since the variable-pitch propeller with the adjustment hydraulics has a large time constant, this response is moderated.

The method known from DE 195 15 481 A1 cannot be exactly translated to a marine propulsion system with a surface-piercing propeller. The reason for this is the significantly shorter response time of the surface-piercing propeller compared to a variable-pitch propeller. For example, an exact translation would cause a large load on the internal combustion engine after a change in the amount of power desired, and as a result, the acceleration of the ship would be delayed.

SUMMARY OF THE INVENTION

The objective of the invention is thus to adapt the method known from the prior art to a marine propulsion system with a surface-piercing propeller.

The method is characterized by the fact that the desired power is interpreted as a set speed and that a speed control deviation is computed from the set speed and the actual speed of the internal combustion engine. An injection quantity for the automatic speed control of the internal combustion engine is in turn determined by a speed controller from the speed control deviation, and an effective speed is computed. The effective speed is the reference input of the system controller, which automatically controls the trim position of the surface-piercing propeller. The power reserve is also taken into account in the automatic control of the trim position.

The method of the invention thus differs from the prior art described above in that the reference input for the system controller is not derived directly from the desired power but rather from the effective speed. Another difference is that the trim position of the surface-piercing propeller is automatically controlled.

The effective speed is computed by an engine map, in which preferably a step function is mapped. Short-term changes in the actual speed, for example, due to waves, cause no change in the effective speed. The effective speed is thus a robust reference input. The effective speed is corrected by internal engine characteristics, for example, the charge pressure of an exhaust gas turbocharger.

A first pitch angle is determined from the effective speed by a trim preassignment unit with several selectable engine maps. The selection of an engine map is made as a function of the number of coupled drive shafts and the direction of thrust, for example, curved travel or reverse travel. The engine maps bring about improved adaptation of the propulsion system to the external conditions. For example, during reverse travel, the trim position is changed in the direction −100%, so that the water moved by the surface-piercing propeller flows through under the stern of the ship. This greatly reduces the flow resistance.

The first pitch angle in turn is processed together with the power reserve in a load control unit, which generates the reference input (here: the second pitch angle) for the trim controller and a first pitch rate. The trim controller then defines the trim position on the basis of the second pitch angle, the actual trim position and the first pitch rate.

In a very general way, the advantages of the invention consist in the fact that the internal combustion engine stays in the tested load range during significant changes in the desired power and that the automatic control of the trim position represents a corresponding convenience for the navigator. In addition, the engine maps are designed in such a way in practice that at each operating point, an economical and effective operating state is automatically adjusted.

BRIEF DESCRIPTION OF THE DRAWINGS

The drawings illustrate a preferred embodiment of the invention.

DETAILED DESCRIPTION OF THE INVENTION

Figure 1:
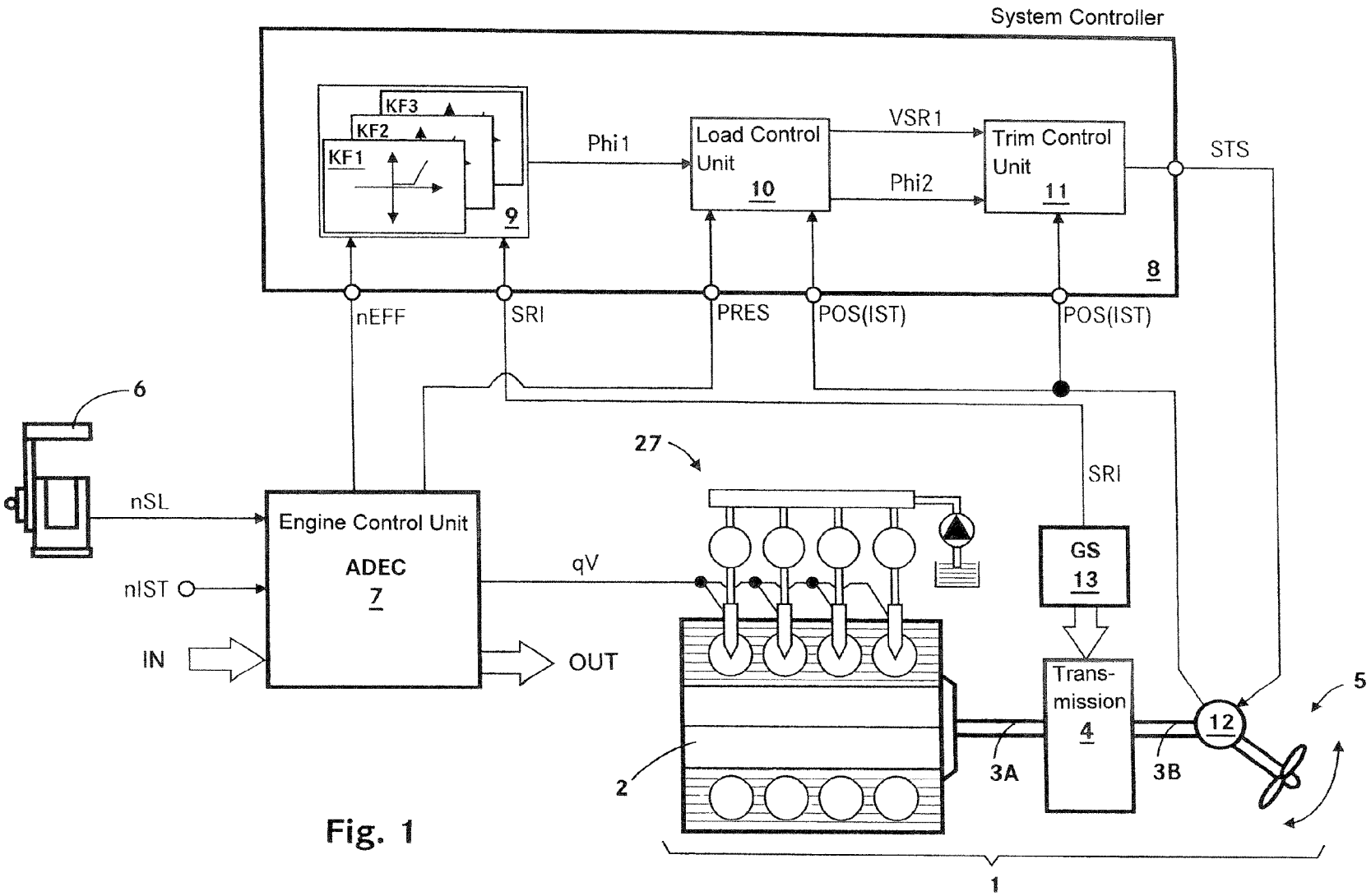
FIG. 1 shows a system diagram.

FIG. 1 shows a system diagram of a marine propulsion system with a surface-piercing propeller. The principal functional components are: the mechanical components of the marine propulsion system 1 with an internal combustion engine 2 together with a transmission 4 and a surface-piercing propeller 5, an electronic engine control unit (ADEC) 7, an electronic transmission control unit (GS) 13, and a system controller 8. The internal combustion engine 2 drives the transmission 4 by a shaft 3A. The transmission 4 usually contains an input shaft and an output shaft and a device for reversing the direction of rotation for forward travel and reverse travel. The activation and the switching state of the transmission 4 are preset by the electronic transmission control unit 13. The transmission 4 drives the surface-piercing propeller 5 by a shaft 3B. The trim position of the surface-piercing propeller 5 can be varied by an actuator 12.

The operating mode of the internal combustion engine 2 is determined by the electronic engine control unit (ADEC) 7, which contains the usual components of a microcomputer system, for example, a microprocessor, interface adapters, buffers, and memory components (EEPROM, RAM). Operating characteristics that are relevant to the operation of the internal combustion engine 2 are applied in the memory components in the form of engine maps/characteristic curves. The electronic engine control unit 7 uses these to compute the output variables from the input variables. FIG. 1 shows the following input variables by way of example: a set speed nSL, which can be preassigned by a throttle control 6, an actual speed nIST, which, for example, is sensed on the shaft 3A and filtered by means of a software filter, and a signal IN. The signal IN represents the other input signals, for example, a rail pressure of the common rail system 27 with individual accumulators, a charge air pressure of the exhaust gas turbochargers, and the temperatures of the coolants/lubricants or of the fuel.

FIG. 1 also shows the following as output variables of the electronic engine control unit 7: a set injection quantity qV, an effective speed nEFF, a signal power reserve PRES, and a signal OUT. The signal OUT represents the other control signals for the open-loop and closed-loop control of the internal combustion engine, for example, a triggering signal for the suction throttle of the common rail system 27 and a control signal for activating a second exhaust gas turbocharger during a register supercharging.

Figure 3:
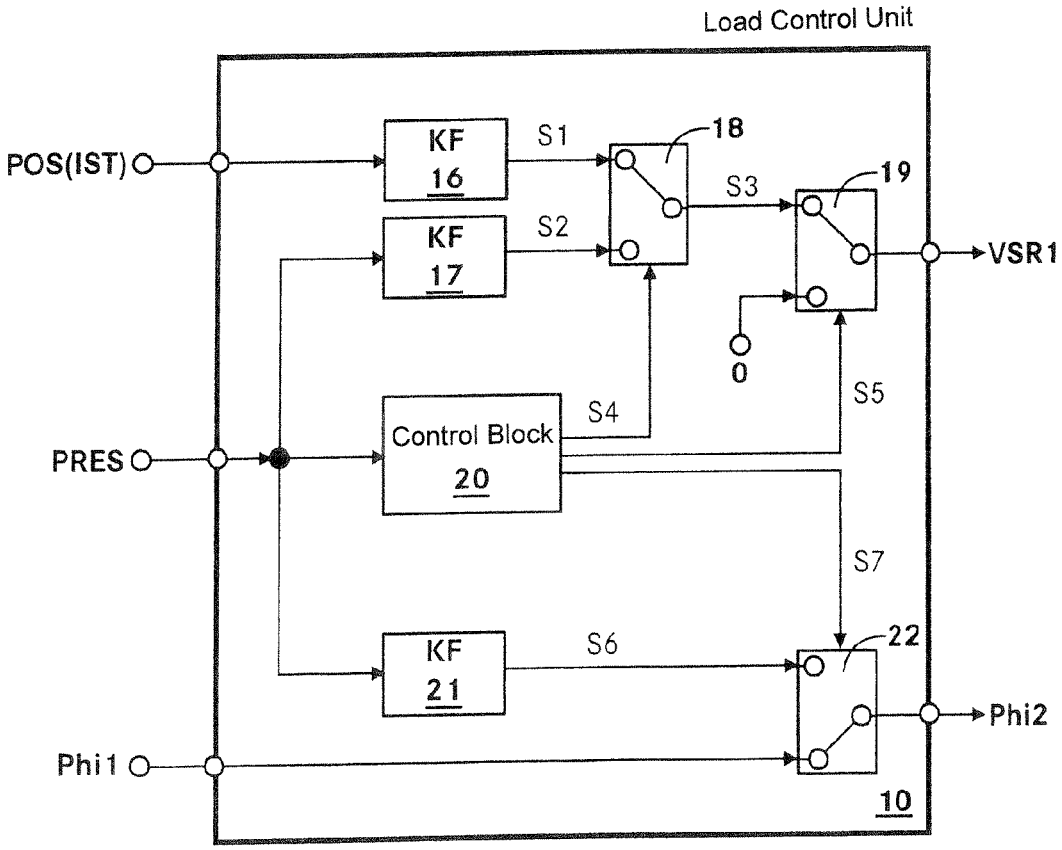
FIG. 3 shows a block diagram of the load control unit.
Figure 4:
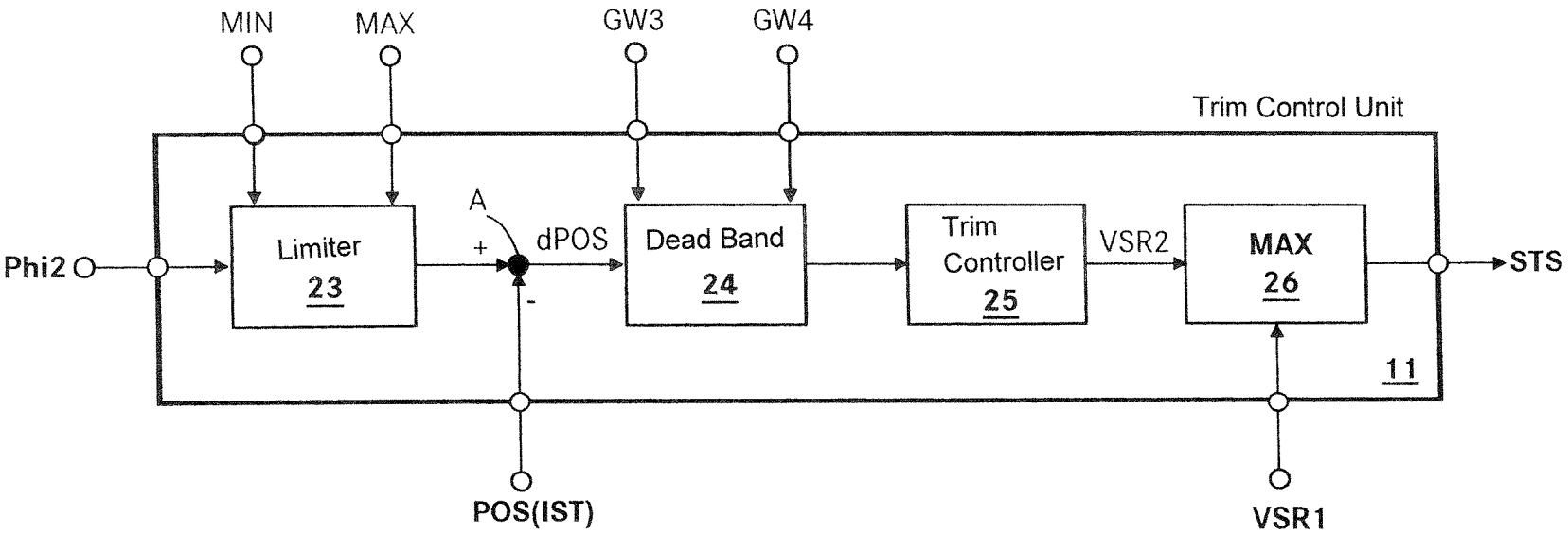
FIG. 4 shows a block diagram of the automatic trim control unit.

The input signals of the system controller 8 are: the effective speed nEFF, the power reserve PRES, a direction of thrust SRI, and the actual trim position POS(IST) of the surface-piercing propeller 5. The output signal of the system controller 8 is a control signal STS for triggering the actuator 12, by which the trim position POS is then adjusted. The system controller 8 presets the control signal STS for conversion to the trim position POS for the surface-piercing propeller as an absolute angular value in degrees, as a percent of the immersion depth, for example, +20%, or as a pitch rate in degrees/second or percent/second. The system controller 8 contains a trim preassignment unit 9 with several selectable engine maps KF1 to KF3, a load control unit 10 for limiting the trim position, and an automatic trim control unit 11 for automatically controlling the trim position POS. The load control unit 10 is shown in FIG. 3 and will be explained below in connection with FIG. 3. The automatic trim control unit 11 is shown in FIG. 4 and will be described in connection with FIG. 4.

Figure 2:
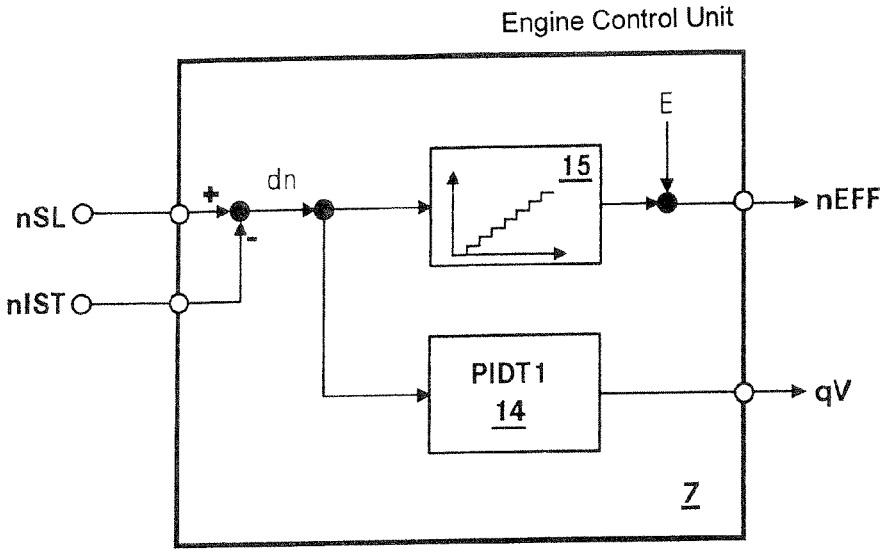
FIG. 2 shows a block diagram of the engine control unit.

The system has the following functionality:

The navigator defines the power he desires via the position of the throttle control 6. The position of the throttle control 6 is interpreted as the set speed nSL. Further explanation will now be provided with reference to FIG. 2, which shows a block diagram of the electronic engine control unit 7. The electronic engine control unit 7 uses the set speed nSL and the actual speed nIST to compute a speed control deviation dn. A speed controller 14, usually a PIDT1 controller, converts the speed control deviation dn to a control signal (here: a set injection quantity qV). The control signal then acts on the injectors of the common rail system 27 with individual accumulators. The speed control deviation dn is likewise used to compute an effective speed nEFF by means of an engine map 15, which in the case illustrated here is a step function. The speed control deviation dn is filtered by means of the step function, i.e., the effective speed nEFF is robust with respect to small deviations. The effective speed nEFF is corrected by a factor E, which designates internal engine characteristics, for example, the charge pressure of an exhaust gas turbocharger.

A first pitch angle Phi1 is determined by the trim preassignment unit 9 from the effective speed nEFF. To this end, the trim preassignment unit 9 contains several engine maps, which are designated KF1, KF2, and KF3 in FIG. 1. An engine map is selected by means of the thrust direction signal SR1 and on the basis of the member of coupled shafts. For example, in the case of a propulsion system with two internal combustion engines, one or two shafts can be coupled. The first pitch angle Phi1, the power reserve PRES, and the actual trim position POS(IST) are the input variables of the load control unit 10. A first pitch rate VSR1 and a second pitch angle Phi2 are determined by the load control unit 10. The load control unit 10 is activated or deactivated as a function of the power reserve PRES of the internal combustion engine 2. The power reserve PRES is defined as the engine power represented by the difference between the power at the current operating point and the maximum possible power for this operating point. With the load control unit 10 activated, the first pitch rate VSR1 and the second pitch angle Phi2 are each computed by an engine map as a function of the power reserve PRES. Alternatively, a constant value can be preassigned. As an additional safety function, the activated load control unit 10 sets the first pitch rate VSR1 to zero if the value of the power reserve PRES lies within a dead band. When the load control unit 10 is deactivated, the second pitch angle Phi2 equals the first pitch angle Phi1. The internal structure of the load control unit is described in greater detail in connection with FIG. 3.

The second pitch angle Phi2 corresponds to the reference input for the automatic trim control unit 11, which will be described in greater detail with reference to FIG. 4. The automatic trim control unit 11 determines the trim position control deviation from the second pitch angle Phi2 and the actual trim position POS(IST) and automatically controls the trim position POS as a function of this control deviation by means of the control signal STS.

FIG. 3 shows the load control unit 10 as a block diagram. The input variables are the actual trim position POS(IST), the power reserve PRES, and the first pitch angle Phi1. The output variables are the first pitch rate VSR1 and the second pitch angle Phi2. An engine map 16 assigns a first signal S1 to the actual trim position POS(IST). The signal S1 is a first input variable of a switch 18. An engine map 17 assigns a second signal S2 to the power reserve PRES. The signal S2 is the second input variable of the switch 18. The output variable of the switch 18 (here: a third signal S3) corresponds either to the first signal S1 or to the second signal S2. The switching state of the switch 18 is determined by a control block 20 via a fourth signal S4. The third signal S3 is an input variable of the switch 19. The second input variable of the switch 19 is the value zero. The switching state of the switch 19 is determined by the control block 20 via a fifth signal S5. The output variable of the switch 19 (here: the first pitch rate VSR1) corresponds either to the value of the third signal S3 or to the value zero. An engine map 21 assigns a sixth signal S6 to the power reserve PRES. The signal S6 is a first input variable of the switch 22. The second input variable of the switch 22 is the first pitch angle Phi1. The switching state of the switch 22 is determined by the control block 20 via a seventh signal S7. The output signal of the switch 22 (here: the second pitch angle Phi2) corresponds either to the value of the sixth signal S6 or to the first pitch angle Phi1.

As an alternative, the load control unit 10 can be designed in such a way that the second signal S2 and the sixth signal S6 are not computed as a function of the power reserve PRES, but rather the two signals are set to a constant value.

The load control unit 10 has the following functionality:

FIG. 3 shows the load control unit in the deactivated state. In the deactivated state, the second pitch angle Phi2 has the same value as the first pitch angle Phi1, which is computed by the trim preassignment unit 9 as a function of the efTective speed nEFF. Since the second pitch angle Phi2 is the reference input for the automatic trim control unit 11, the trim position POS of the surface-piercing propeller 5 is defined by the effective speed nEFF. The first pitch rate VSR1 is determined in the deactivated state as a function of the actual trim position POS(IST).

When the load control unit 10 changes from the deactivated state to the activated state, the switches 18 and 22 change their switching position. This change is initiated by the control block 20. In the activated state, both the second pitch angle Phi2 and the first pitch rate VSR1 are computed (engine maps 17, 21) as a function of the power reserve PRES. The load control unit 10 is active if PRES<GW1 after t1 (turn-on delay) or PRES<GW1+GW2 or PRES>GW1+GW2 before t2 has elapsed (turn-off delay)

where PRES is the power reserve, GW1 and GW2 are freely applicable limits, and t1 and t2 are time stages.

The control block 20 changes the switching state of the switch 19 by the fifth signal S5 if the load control unit 10 is activated and the following condition is present:

GW1<PRES<GW1+GW2 (dead band)

In this case, the pitch rate VSR1 has the value zero.

FIG. 4 shows the automatic trim control unit 11 as a block diagram. The input variables are: the second pitch angle Phi2, the first pitch rate VSR1, the actual trim position POS(IST), a third limit GW3 and a fourth limit GW4, a minimum pitch angle MIN, and a maximum pitch angle MAX. The output variable of the automatic trim control unit 11 is the connecting variable STS, which acts on the actuator 12 to adjust the surface-piercing propeller 5. The second pitch angle Phi2 is controlled by a limiter 23 to the value MIN and MAX. At a point A, a position control deviation dPOS is then determined from the second pitch angle Phi2 and the actual trim position POS(IST). Control deviations in the range between the two limits GW3 and GW4 arc suppressed by means of a dead band 24. A trim controller 25, preferably with PID response, determines a second pitch rate VSR2 from the control deviation dPOS. Either the first pitch rate VSR1 or the second pitch rate VSR2 is determined by a maximum value selector MAX 26 as a correcting variable STS for controlling the actuator 12. The control signal STS can be preset as an absolute angular value in degrees, as a percent of the immersion depth, for example, +20%, or as a pitch rate in degrees/second or percent/second.

Figure 5:
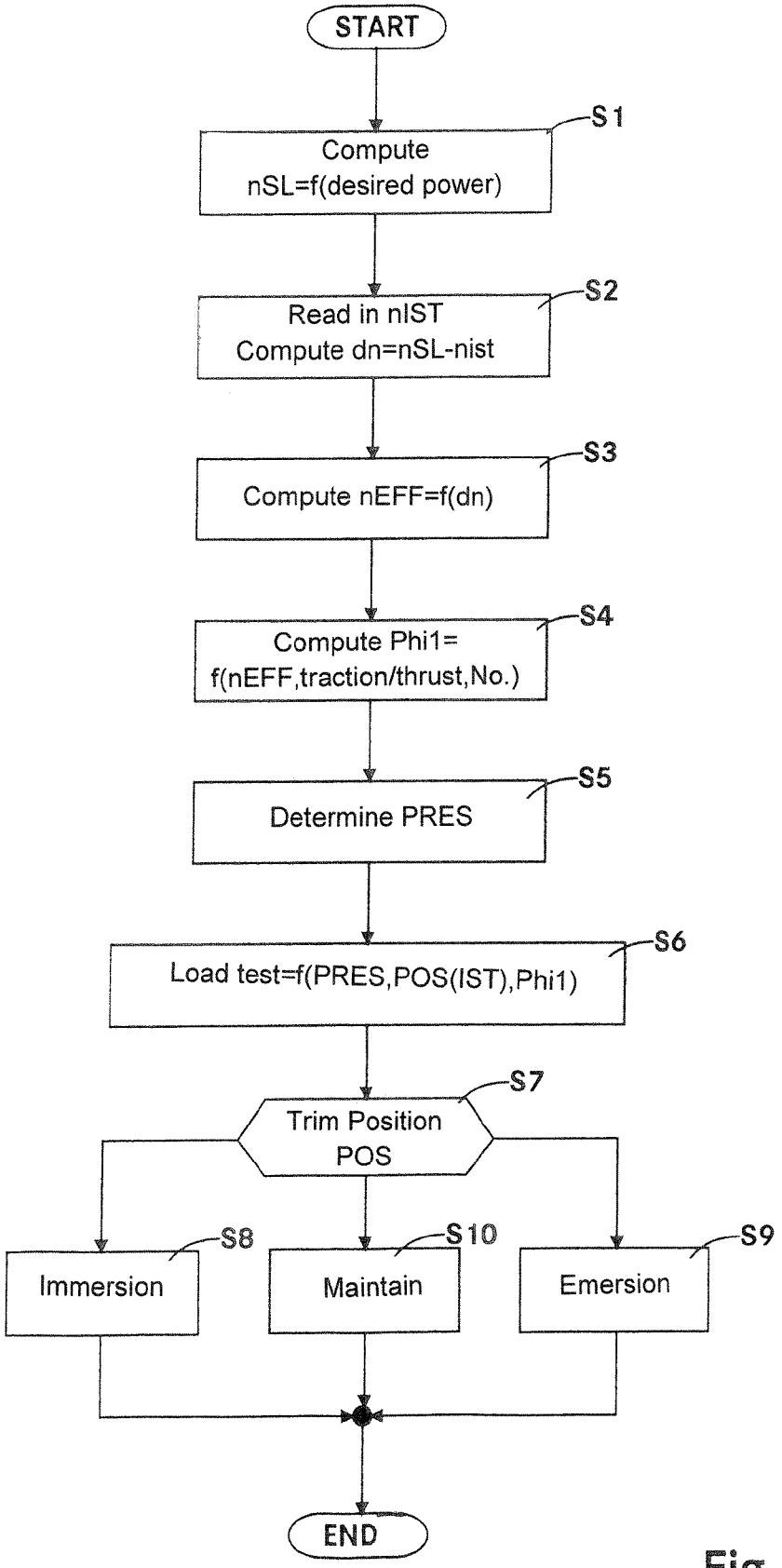
FIG. 5 shows a program flowchart.

FIG. 5 shows a simplified program flowchart. At S1 the set speed nSL is detennined from the power desired by the navigator. The set speed nSL is the reference input of the closed-loop speed control system and of the system controller 8. At S2 the actual speed nIST is then read in, and the speed control deviation dn is computed from the difference between the set speed nSL and the actual speed nIST. At S3 the effective speed nEFF is computed from the speed control deviation dn by a step function stored in the engine map 15. At S4 the effective speed nEFF is then used by the trim preassignment unit 9 to compute the first pitch angle Phi1 as a function of the direction of thrust and the number of coupled shafts. At S5 the power reserve PRES is determined. The power reserve PRES is defined as the engine power represented by the difference between the power at the current operating point and the maximum possible power for this operating point. A load test is then carried out at S6. This step is carried out in the load control unit 10 on the basis of the previously described activation or deactivation conditions. At S7 the automatic trim control unit uses the actual trim position POS(IST) and the output variables of the load control unit 10 (here: the second pitch angle Phi2 and the first pitch rate VSR1) to test whether the trim position should be changed (S8: immersion or S9: emersion) or whether the trim position should be maintained (S10). The program flowchart then ends.

The specification reveals the following advantages of the invention:

- The reference input for the system controller is formed to a considerable extent from the set speed, so that when significant changes in the desired power occur, safe and overload-free operation of the internal combustion engine is achieved.
- The automatic control of the trim position relieves the navigator of this burden, which offers him greater convenience.
- Small actual speed fluctuations, for example, due to waves, are suppressed, which means that high-performance automatic control of the trim position is achieved.
- An economical and effective operating state is automatically adjusted at each operating point.

LIST OF REFERENCE NUMBERS

1 marine propulsion system
2 internal combustion engine
3 shaft
4 transmission
5 surface-piercing propeller
6 throttle control
7 electronic engine control unit (ADEC)
8 system controller
9 trim preassignment unit
10 load control unit
11 automatic trim control unit
12 actuator
13 electronic transmission control unit (GS)

14 speed controller
15 engine map
16 engine map
17 engine map
18 switch
19 switch
20 control block
21 engine map
22 switch
23 limiter
24 dead band
25 trim controller
26 maximum value selector
27 common rail system

The invention claimed is:

1. A method for automatically controlling a marine propulsion system with an internal combustion engine and a surface-piercing propeller, comprising the steps of: considering a desired power to be a set rotational speed (nSL); computing a rotational speed control deviation (dn) from the set rotational speed (nSL) and an actual rotational speed (nIST) of the internal combustion engine in a processor; determining an injection quantity (qV) in the processor for automatic rotational speed control of the internal combustion engine by a rotational speed controller from the rotational speed control deviation (dn); computing an effective rotational from rotational speed deviation (dn) in the processor using a step function engine map to provide a robust effective rotational speed; and con troll trim position (POS) of the surface-piercing propeller with a system controller in response to signals from the processor as a function of a power reserve (PRES) of the internal combustion engine, of an actual trim position (POS(IST)), and of the effective rotational speed (nEFF) that is determined from the rotational speed control deviation (dn), the trim position being adjusted by an actuator by only adjusting a shaft that drives the surface-piercing propeller in response to signals from the system controller.

2. The method in accordance with claim 1, wherein the effective rotational speed (nEFF) is computed by the engine map from the rotational speed control deviation (dn) and another input variable (E).

3. The method in accordance with claim 2, wherein the another input variable is a charge pressure of an exhaust gas turbocharger.

4. The method in accordance with claim 2, wherein a first pitch angle (Phi1) is determined from the effective rotational speed (nEFF) by a trim preassignment unit with several selectable additional engine maps (KF1, KF2, KF3).

5. The method in accordance with claim 4, wherein one of the selectable engine maps (KF1, KF2, KF3) is selected as a function of a number of coupled shafts and a thrust direction signal (SRI) of a transmission.

6. The method in accordance with claim 4, wherein a second pitch angle (Phi2) and a first pitch rate (VSR1) are computed by a load control unit as a function of the first pitch angle (Phi1), the power reserve (PRES), and the actual trim position (POS(IST)) of the surface-piercing propeller.

7. The method in accordance with claim 6, wherein, when the load control unit is in an activated state, the first pitch rate (VSR1) and the second pitch angle (Phi2) are computed by further engine maps as a function of the power reserve (PRES) or, alternatively, are set at a constant value.

8. The method in accordance with claim 7, wherein, when the load control unit is in the activated state, the first pitch rate (VSR1) is set to zero if the value of the power reserve (PRES) lies within a dead band (GW1, GW2).

9. The method in accordance with claim 6, wherein, when the load control unit is deactivated, the second pitch angle (Phi2) equals the first pitch angle (Phi1).

10. The method in accordance with claim 6, including computing a position control deviation (dPOS) from the second pitch angle (Phi2) and the actual trim position (POS (IST)), and determining a second pitch rate (VSR2) by a trim controller from the position control deviation (dPOS).

11. The method in accordance with claim 10, including setting either the first pitch rate (VSR1) or the second pitch rate (VSR2) as controlling for a control signal (STS) for determining the trim position (POS) of the surface-piercing propeller.

* * * * *